US009632457B2

(12) United States Patent
Koseki et al.

(10) Patent No.: US 9,632,457 B2
(45) Date of Patent: Apr. 25, 2017

(54) IMAGE FORMING APPARATUS

(71) Applicant: CANON KABUSHIKI KAISHA, Tokyo (JP)

(72) Inventors: Hiromichi Koseki, Saitama (JP); Dai Kanai, Abiko (JP); Takeshi Yasumoto, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/074,389

(22) Filed: Mar. 18, 2016

(65) Prior Publication Data

US 2016/0202636 A1 Jul. 14, 2016

Related U.S. Application Data

(63) Continuation of application No. PCT/JP2014/075762, filed on Sep. 19, 2014.

(30) Foreign Application Priority Data

Sep. 19, 2013 (JP) ..... 2013-194577

(51) Int. Cl.
*G03G 21/10* (2006.01)
*G03G 15/08* (2006.01)

(52) U.S. Cl.
CPC ..... *G03G 15/0886* (2013.01); *G03G 21/105* (2013.01)

(58) Field of Classification Search
None
See application file for complete search history.

(56) References Cited

U.S. PATENT DOCUMENTS 6,785,497 B1 * 8/2004 Hasebe ..... G03G 15/0872 222/DIG. 1
9,261,850 B2 2/2016 Koseki
(Continued)

FOREIGN PATENT DOCUMENTS

JP 63-200862 U 12/1988
JP 02-069361 U 5/1990
(Continued)

OTHER PUBLICATIONS

International Search Report dated Nov. 14, 2014, in PCT/JP2014/075762.

*Primary Examiner* — David Gray
*Assistant Examiner* — Thomas Giampaolo, II
(74) *Attorney, Agent, or Firm* — Fitzpatrick, Cella, Harper & Scinto

(57) ABSTRACT

In an image forming apparatus that includes a collection container for collected toner, the collection container is not easily pushed back by a reaction force against a closing force of a shutter provided in a feeding portion for the collected toner. A spiral rib guides a contact rib to move the sealing shutter in a direction of opening a transfer opening against an urging force of a twisted coil spring in the process of connecting a collected toner box to a feeding pipe. A low reaction force area guides the contact rib after the spiral rib in the process of connecting the collected toner box to the feeding pipe. An inclination angle of the low reaction force area relative to the direction of connecting the collected toner box is less than an inclination angle of the spiral rib relative to the direction of connection of the collected toner box.

9 Claims, 9 Drawing Sheets

(56) References Cited

U.S. PATENT DOCUMENTS

| | | | | |
|---|---|---|---|---|
| 2013/0223873 | A1* | 8/2013 | Manabe | G03G 15/0844 399/102 |
| 2014/0321896 | A1* | 10/2014 | Morishita | G03G 21/12 399/358 |
| 2015/0086256 | A1* | 3/2015 | Koseki | G03G 21/1647 399/360 |

FOREIGN PATENT DOCUMENTS

| | | | |
|---|---|---|---|
| JP | 2002-311772 | A | 10/2002 |
| JP | 2005-077513 | A | 3/2005 |
| JP | 2006-078767 | A | 3/2006 |
| JP | 2013-068752 | A | 4/2013 |

* cited by examiner (a)

(b)

(c)

(a)

(b)

(c)

IMAGE FORMING APPARATUS

TECHNICAL FIELD

The present invention relates to an image forming apparatus which cumulatively stores, in its collection container, the toner which is collected in the image forming section and is conveyed to a conveying section. More specifically, it relates to a shutter with which the conveying section is provided. There have been widely in use image forming apparatuses which form a toner image in their image forming section, transfer the toner image onto a recording medium, directly or by way of their intermediary transferring component, and fix the toner image to the recording medium by applying heat and pressure to the recording medium with the use of their fixing device.

BACKGROUND ART

As a toner image is formed in the image forming section, and is transferred, a certain amount of toner remains on the image bearing component and intermediary transferring component, and is collected by the cleaning device of the apparatus. In some cases, a developing device discharges little by little the deteriorated developer. Ordinarily, the collected toner and collected developer are conveyed from the image forming section through the conveying section, and are cumulatively stored in the collection container disposed in the housing of the image forming apparatus. As the collection container becomes full, the collection container is taken out of the housing of the image forming apparatus, and is replaced with an empty collection container (Japanese Laid-open Patent Application No. 2005-77513).

There is disclosed in Japanese Laid-open Patent Application No. 2005-77513, an image forming apparatus which is provided with multiple image forming sections, multiple conveying sections connected to the image forming sections, one for one, and a single collection container. The image forming apparatus is structured so that the multiple conveying sections can be connected to, or separated from, one of the lateral walls of the collection container. The downstream end of each conveying section is provided with a shutter which is under the pressure generated by a spring in the direction to keep the conveying section closed. Thus, as the collection container is separated from the conveying section, the shutter automatically seals the conveying section to prevent toner leakage.

In the case of the image forming apparatus disclosed in Japanese Laid-open Patent Application No. 2005-77513, the multiple shutters press on the collection container in the direction in which the shutters are closed. Therefore, in order to prevent the collection container from being pushed out of the housing of the image forming apparatus, it is necessary for the collection container to be fixed to the housing of the image forming apparatus with the use of a binding belt, a locking lever, or the like.

In the case of the image forming apparatus disclosed in Japanese Laid-open Utility Model Application No. H02-69361, it is structured so that the direction in which the shutter is rotationally moved to be opened or closed is perpendicular to the direction in which the collection box 2 is inserted into the housing of the image forming apparatus. Further, it is structured so that as the collection box 2 is inserted into the housing of the image forming apparatus, a tilted surface 11 with which the collection box 2 is provided, causes the lever 28, with which the shutter is provided, to move in the direction to rotate the shutter. Moreover, it is structured so that by the time the collection box 2 is moved all the way into its designated position in the image forming apparatus, the lever 28 will have slid past the flat surface 10 of the collection box 2, and will have been caught by a protrusion 9 which protrudes from the flat section of the collection box 9. Therefore, the collection box 2 is not pushed back by the force generated by the spring provided to press the shutter. However, the image forming apparatus disclosed in Japanese Laid-open Utility Model Application No. H02-69361 is structured so that as the lever with which the shutter is provided is moved by the flat surface of the collection box 2, which is tilted by a preset angle relative to the direction in which the collection box 2 is inserted into the housing of the image forming apparatus, the shutter is rotated by the lever. Therefore, the lever 28 could not be rotated by a large angle, which is problematic.

SUMMARY OF THE INVENTION

Thus, the primary object of the present invention is to provide an image forming apparatus which does not have a locking component for keeping the collection container fixed in position in its housing, and yet, can prevent the collection container from being pushed out of the housing by the pressure generated by a spring provided to keep the shutter pressured, and which is substantially greater in the amount (angle) by which the shutter is rotated by the insertion of the collection container into the housing of the image forming apparatus than any conventional image forming apparatus.

The present invention provides an image forming apparatus comprising an image forming portion configured to form a toner image; a feeding portion configured to feed toner collected in said image forming portion; a collection container connectable with and disconnectable from said feeding portion and configured to accumulate the collected toner entering through an opening of said feeding portion; a shutter provided on said feeding portion and movable in a direction crossing with a direction of connection with said collection container, said shutter being capable of opening and closing said opening; an urging member configured to urge said shutter in a closing direction; a drive receiving portion provided on said shutter and configured to receive a driving force from said collection container in a process of connecting said collection container to said feeding portion; and a drive applying portion provided on said collection container and contactable to said drive receiving portion in the process of connecting said collection container to said feeding portion to apply a driving force for moving said shutter in an opening direction against a force applied by said urging member; wherein one of said drive applying portion and said drive receiving portion includes a first contact path contactable to the other portion in the process of connecting said collection container to said feeding portion, and a second contact path contactable to the other portion after said first contact path, and wherein an inclination angle of said second contact path relative to the direction of connecting said collection container to said feeding portion is less than an inclination angle of said first contact path relative to the direction of connecting said collection container to said feeding portion, wherein said first contact path includes a spiral portion provided on a periphery of said feeding portion, and said shutter is rotated by the other portion contacting said spiral portion.

EMBODIMENTS OF THE INVENTION

Hereinafter, some of the preferred embodiments of the present invention are described in detail with reference to the appended drawings.

Embodiment 1

Image Forming Apparatus

Figure 1:
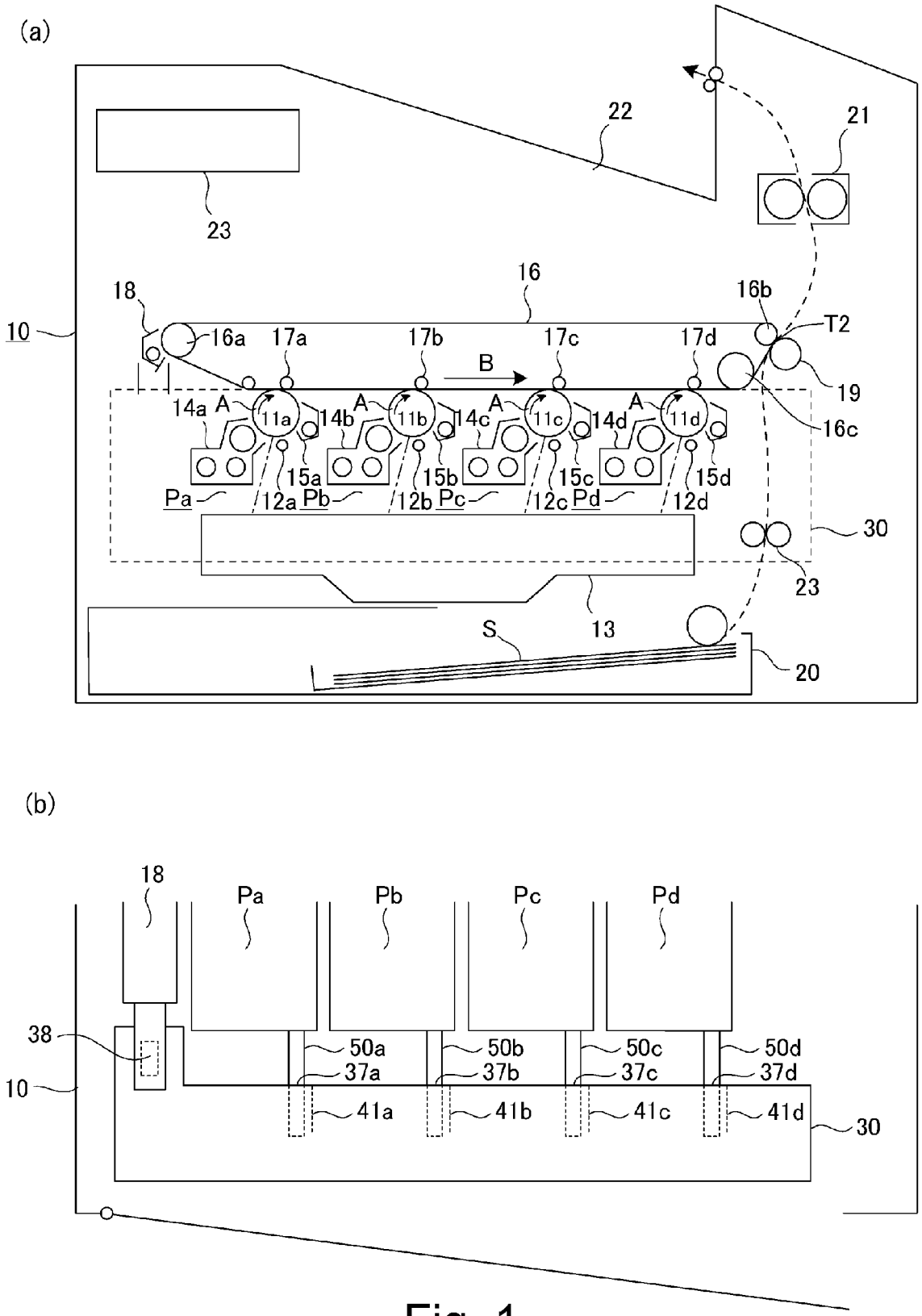
FIG. 1 is a drawing for describing the structure of the image forming apparatus.

FIG. 1 is a drawing for describing the structure of the image forming apparatus in this embodiment. More specifically, FIG. 1(*a*) is a vertical sectional view of the image forming apparatus, and FIG. 1(*b*) is a drawing for describing the state of connection of the collected toner box to the transferring sections of the image forming apparatus.

Referring to FIG. 1(*a*), the image forming apparatus 10 is a full-color printer of the so-called tandem type, and also, so-called intermediary transfer type. It has an intermediary transfer belt 16, and image forming sections Pa, Pb, Pc and Pd which are aligned along the intermediary transfer belt 16 to form yellow, magenta, cyan and black toner images, respectively. The operation of the image forming apparatus 10 is controlled by a control section 23 of the apparatus 10.

In the image forming section Pa, a yellow toner image is formed on its photosensitive drum 11*a*, and is transferred onto the intermediary transfer belt 16. In the image forming section Pb, a magenta toner image is formed on its photosensitive drum 11*b*, and is transferred onto the intermediary transfer belt 16. In the image forming sections Pc and Pd, cyan and black toner images are formed on their photosensitive drums 11*c* and 11*d*, respectively, and are transferred onto the intermediary transfer belt 16.

Sheets S of recording medium are moved out one by one from a cassette 20. Each sheet S is kept on standby by a pair of registration rollers 23, which convey the sheet S to the secondary transferring section T2 with such timing that the sheet S arrives at the secondary transferring section T2 at the same time as the four toner images on the intermediary transfer belt 16. After the transfer (secondary transfer) of the four toner images, different in color, onto the sheet S, the sheet S is conveyed to the fixing device 21, in which the toner images are fixed to the sheet S by the application of heat and pressure. Then, the sheet S is discharged into a delivery tray 22.

(Image Forming Section)

Referring to FIG. 1(*a*), the image forming sections Pa, Pb, Pc and Pd are practically the same in structure, although they are different in the color of the toner their developing devices 14*a*, 14*b*, 14*c* and 14*d* (which use yellow, magenta, cyan and black toners, respectively) use. Hereafter, therefore, only the image forming section Pa, which forms a yellow toner image, is described in order not to repeat the same description.

The image forming station Pa comprises a charging roller 12*a*, an exposure device 13, a developing device 14*a*, a transfer roller 17*a* and a drum cleaning device 15*a* around the photosensitive drum 11. The photosensitive drum 11*a* includes a photosensitive layer at the outer peripheral surface thereof and is rotatable in a direction indicated by an arrow A.

The charge roller 12*a* uniformly and negatively charges the peripheral surface of the photosensitive drum 11*a* to a preset potential level VD (pre-exposure level). The exposing device 13 scans the uniformly charged peripheral surface of the photosensitive drum 11*a* with a beam of laser light which it outputs while modulating (turning on or off) the beam in response to image formation signals which correspond to pixels into which the image to be formed was divided. Thus, the exposed (illuminated) points of the uniformly charged peripheral surface of the photosensitive drum 11*a* reduce in potential level to a preset potential level VL (post-exposure level). Consequently, an electrostatic image is effected on the peripheral surface of the photosensitive drum 11*a*.

The developing device 14*a* develops the electrostatic image on the photosensitive drum 11*a* into a visible image (image formed of toner, which hereafter will be referred to simply as toner image), with the use of developer which is a mixture of toner and carrier, by charging the toner (negatively) and carrier (positively), and causing the developer (mixture of charged toner and carrier) to be borne by its development sleeve in such a manner that the developer crests in the form of a brush.

The transfer roller 17*a* forms a transferring section between the photosensitive drum 11*a* and intermediary transfer belt 16 by pressing the intermediary transfer belt 16 against the photosensitive drum 11*a* from the inward side of the intermediary transfer belt 16 (in terms of loop which intermediary transfer belt 16 forms). As positive DC voltage is applied to the transfer roller 17*a*, the toner image on the photosensitive drum 11*a* is transferred onto the intermediary transfer belt 16.

The intermediary transfer belt 16 is suspended by a combination of a tension roller 16*a*, a driver roller 16*c*, and an inward secondary transfer roller 16*b* in such a manner that the intermediary transfer belt 16 bridges between the adjacent two rollers. It circularly moves in the direction indicated by an arrow mark B by being driven by the driver roller 16*c*. The secondary transfer roller 19 forms the toner image transferring second section T2 by being placed in contact with the portion of the intermediary transfer belt 16, which is backed up by the inward secondary transfer roller 16*b*.

(Developer Collection)

Referring to FIG. 1(*a*), during an image forming operation, a certain amount of toner remains adhered to the peripheral surface of the photosensitive drum 11*a* even after the primary transfer of the toner image. This remaining toner, which hereafter will be referred to as transfer residual toner, is scraped away by the cleaning blade of a drum cleaning device 15*a*, and is conveyed to the front side of the image forming apparatus 10 by a conveyance screw. Then, it is cumulatively stored in a collection container 30. As for the toner remaining adhered to the intermediary transfer belt 16 after the secondary transfer, it is scraped away by a cleaning blade of a belt cleaning device 18, and is conveyed to the front side of the image forming apparatus 10. Then, it is cumulatively stored in the collection container 30.

As two-component developer continues to be stirred in the developing device 14*a* for an extended length of time, it gradually reduces in its ability to become charged Thus, the developer in the developing device 14*a* is continuously moved out of the developing device 14*a* at a preset rate, and is collected into the collection container 30. In order to replenish the developing device 14*a* with toner by an amount which is equivalent to the amount by which toner is consumed by image formation, the developing device 14*a* is replenished with replenishment developer which contains carrier by 10%. As the developer in the developing device 14*a* is circularly moved in the developing device 14*a*, it is made to overflow from the developing device 14*a* by a small amount which corresponds to the amount by which toner is consumed for image formation. The developer having overflowed from the developing device 14*a* is cumulatively stored, as deteriorated toner, in the collection container 30.

Referring to FIG. 1(*b*), the connective section of the belt cleaning device 18, and each of the transferring sections 50*a*, 50*b*, 50*c* and 50*d* of the drum cleaning devices 15*a*, 15*b*, 15*c* and 15*d*, respectively, are provided with their own shutter. They are connected to the collected toner box 30.

(Collected Toner Box)

Figure 2:
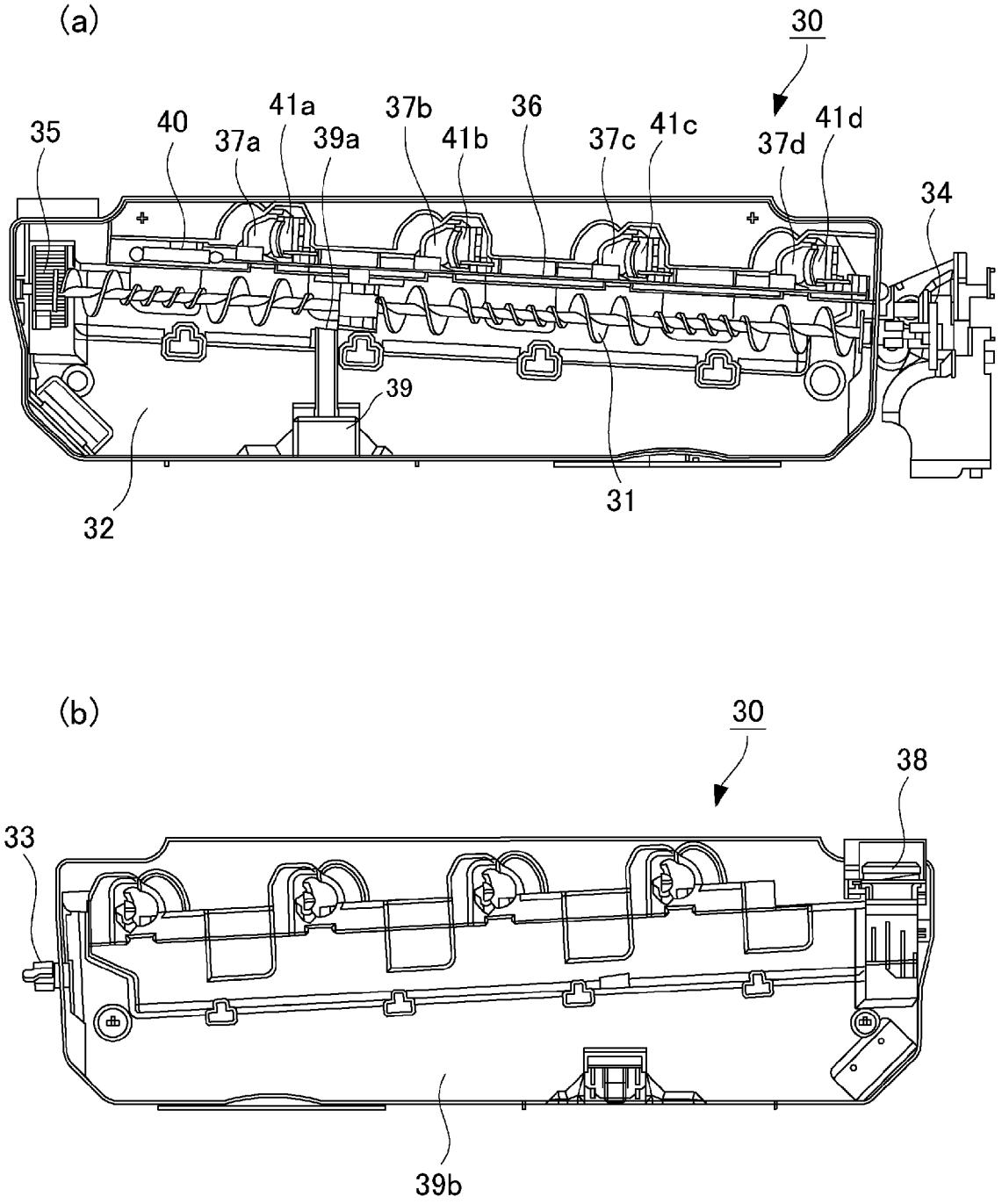
FIG. 2 is a drawing for describing the structure of the collected toner box.
Figure 3:
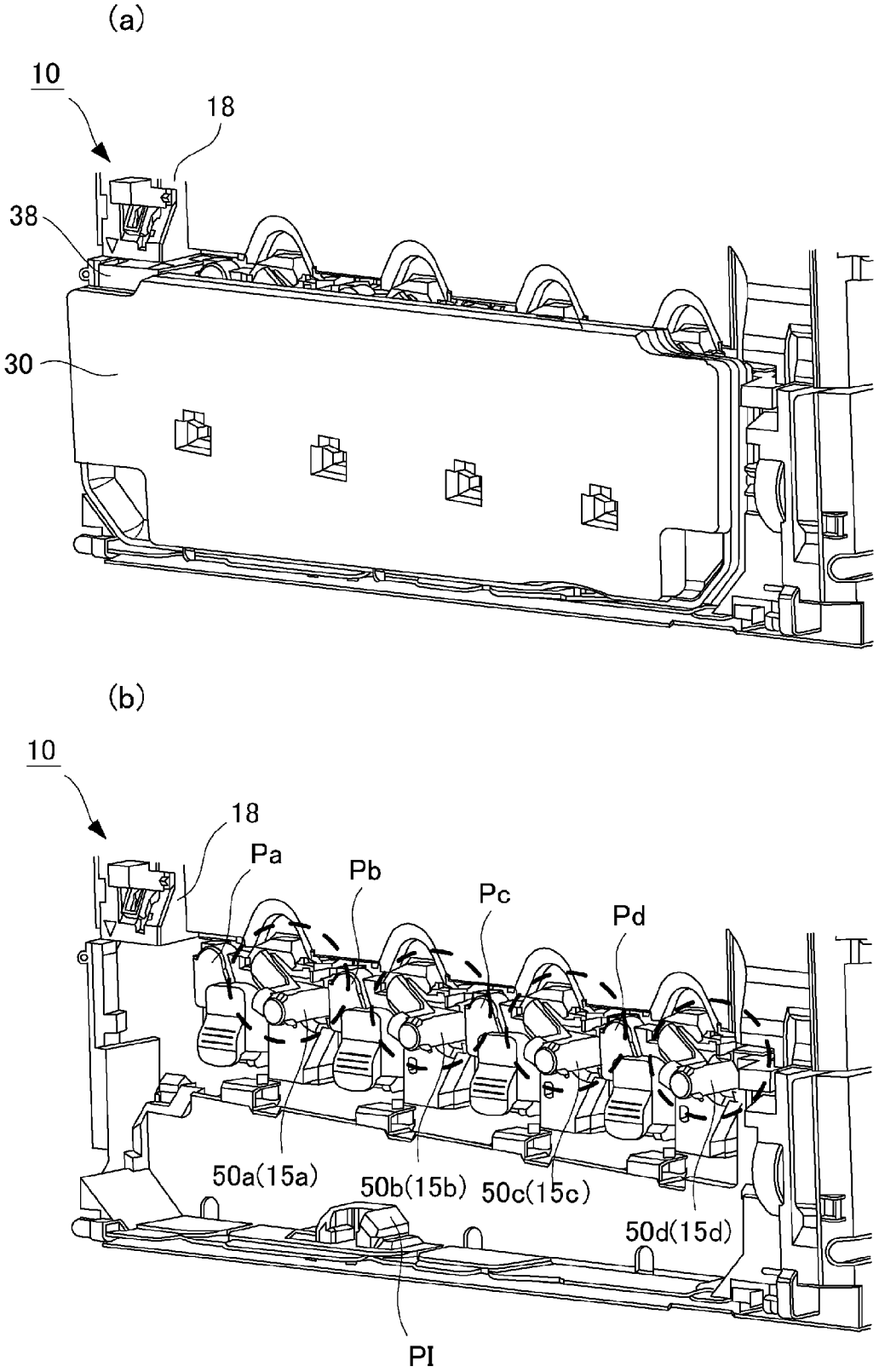
FIG. 3 is a drawing for describing the manner in which the collected toner box is attached to the image forming apparatus.

FIG. 2 is a drawing for describing the structure of the collected toner box. FIG. 3 is a drawing for describing the manner in which the collected toner box 30 is attached. FIG. 2(*a*) is a sectional view of the collected toner box, at a plane which is parallel to the front surface of the image forming apparatus 10, and FIG. 2(*b*) is a rear view of the collected toner box. FIG. 3(*a*) is a rear view of the developer (toner) collection box section of the image forming apparatus 10, when the collected toner box is in the collection section. FIG. 3(*b*) is a rear view of the developer (toner) collection box section of the image forming apparatus 10, when the collected toner box 30 is not in connection to the image forming apparatus 10.

Referring to FIG. 2(*a*), a stirring screw 31 stirs the toner in the space 32 in the collected toner box 30. A screw flag 33 is in the bosses of a coupling 34. It transmits the driving force from the motor of the image forming apparatus 10 to the stirring screw 31. As the collected toner discharged into the collected toner box 30 accumulates as high as the stirring screw 31, it is leveled in the space 32 by the stirring screw 31.

A stirring paddle 35 reciprocally moves in the direction which is perpendicular to the surface of the drawing, by being driven by an unshown crankshaft which moves with the stirring screw 31. As the residual toner is discharged from the belt cleaning device 18, shown in FIG. 1(*a*), and accumulates in a space which is on the inward side of the shutter 38, shown in FIG. 2(*b*), the stirring paddle 35 scrapes the residual toner in the space down into the toner storage chamber 32.

(Fullness Detection)

Referring to FIG. 2(*a*), as the body of the collected toner in the toner storage chamber 32 reaches an entrance 39*a* which is on the top side of a toner amount detecting section 39, while being leveled by the stirring screw 31, the collected toner enters the toner amount detecting section 39. Referring to FIG. 3(*b*), the toner amount detecting section 39 is always monitored by a photo-interrupter P1 with which the main assembly of the image forming apparatus 10 is provided, regarding whether or not toner is present. As the collected toner accumulates in the detecting section 39*b* in such an amount that it blocks the light path of the photo-interrupter, the control section (23 in FIG. 1) determines that the collected toner box 30 is full, and displays across the control panel, a message which demands that the collected toner box 30 is to be replaced.

By the way, the timing with which the control section 23 determines that the collected toner box 30 is full is not limited to immediately after the light path of the toner amount detecting section 39 is blocked. It may be several images after the interruption. The means for detecting that the collected toner box 30 is full does not need to be limited to the photo-interrupter. Further, it does not matter whether the toner in the toner amount detecting section 39 is directly or indirectly detected. Moreover, the method for detecting whether the amount of the collected toner in the storage chamber 32 has become large enough for the body of the collected toner to reach a preset level may be a non-contact method which employs a ultrasonic sensor, an inductance sensor, or the like, or a contact method which employs a piezoelectric sensor, a push-switch, or the like.

(Mounting and Dismounting of Collected Toner Box)

When the image forming apparatus 10 is in the first state as shown in FIG. 3(*b*), the collected toner box 30 (FIG. 2) is not in the bottom portion of the image forming apparatus 10, and therefore, the belt cleaning device 18 and image forming sections Pa, Pb, Pc, and Pd are exposed, and so are the transferring sections 50*a*, 50*b*, 50*c* and 50*d* which are protruding from the image forming sections Pa, Pb, Pc and Pd, respectively. Each of the joints between the connective sections of the belt cleaning device 18 and the transferring sections 50*a*, 50*b*, 50*c* and 50*d* of the drum cleaning devices 15*a*, 15*b*, 15*c* and 15*d*, respectively, is remaining sealed with a shutter.

Referring to FIG. 2(*a*), between the top space to which the transferring sections 50*a*, 50*b*, 50*c* and 50*d* are connected, and the bottom space 32 (storage chamber), a sealing component 36 is disposed so that it remains pressured by a tension spring in the direction to seal each of the aforementioned joints between the connective sections of the belt cleaning device 18 and the transferring sections 50*a*, 50*b*, 50*c* and 50*d*. The entrances 37*a*, 37*b*, 37*c* and 37*d* are provided with entrance shutters 41*a*, 41*b*, 41*c* and 41*d*, respectively, which are moved by the movement of the sealing component 36. When the image forming apparatus 10 is in the first state, the sealing component 36 and entrance shutters 41*a*, 41*b*, 41*c* and 41*d* keep the entrances 37*a*, 37*b*, 37*c* and 37*d* sealed. Thus, even if the collected toner box 30 falls down, the collected toner in the collected toner box 30 does not come out of the box 30.

Also when the image forming apparatus 10 is in the first state, the sealing component 36 which is for keeping sealed the joint between the entrance 37 and storage section 32 keeps sealed between the entrance 39*a* of the toner amount detecting section 39 and the storage section 32. Therefore, it is prevented that as the collected toner box 30 falls down, or the like incident occurs, toner enters the entryway 39*a* of the toner amount detecting section 39.

When the image forming apparatus 10 is in the second state as shown in FIG. 3(*a*), the collected toner box 30 is in its preset position in the image forming apparatus 10, with the transferring sections 50*a*, 50*b*, 50*c* and 50*d* inserted in the entryway 37*a*, 37*b*, 37*c* and 37*d*, respectively, of the collected toner box 30. As the connective section 18*e* is connected to the transferring sections 50*a*, 50*b*, 50*c* and 50*d*, it becomes possible for the collected toner box 30 to accept the collected toner. The transfer residual toner collected by the drum cleaning devices 50*a*, 50*b*, 50*c* and 50*d* is discharged into the collected toner box 30 through transfer openings 51*a* (FIG. 4), 51*b*, 51*c* and 51*d*, with which the bottom side of the transferring sections 50*a*, 50*b*, 50*c* and 50*d*, respectively, is provided.

When the bottom portion of the image forming apparatus 10 is in the second state as shown in FIG. 2(*a*), the entrance shutters 41*a*, 41*b*, 41*c* and 41*d* are open inward of the collected toner box 30, because, as the collected toner box 30 is installed into the image forming apparatus 10, the entrance shutters 41*a*, 41*b*, 41*c* and 41*d* are pushed inward of the collected toner box 30 by the transferring sections 50*a*, 50*b*, 50*c* and 50*d*, respectively. As the entrance shutters 40 are opened inward, the sealing components 36 are slid by the movement of the shutters 41 against the resiliency of the tension spring 40. Consequently, the entrances 37*a*, 37*b*, 37*c* and 37*d* become connected to the storage section 32.

(Connection of Belt Cleaning Device)

Referring to FIG. 2(*b*), the connective opening of the collected toner box 30, which faces the belt cleaning device 18 (FIG. 1), is provided with a shutter 38, which is slidable in the direction in which the collected toner box 30 is inserted into, or pulled out of, the bottom portion of the image forming apparatus 10, in order to open or close the connective opening. The shutter 38 remains pressured by an unshown spring in the direction to keep the connective opening of the collected toner box 30 sealed. When the image forming apparatus 10 is in the aforementioned first state, the shutter 38 keeps the connective opening sealed. Therefore, even if the collected toner box 30 falls down, the toner does not leak from the collected toner box 30.

As the collected toner box 30 is inserted into the image forming apparatus 10, the shutter 38 slides in the direction to expose the connective opening, connecting thereby the toner outlet of the belt cleaning device 18 to the internal space of the collected toner box 30. If a shutter which has to be slid in the direction parallel to the direction in which the collected toner box 30 is to be moved in order for the box 30 to be inserted into, or pulled out of, the image forming apparatus 10, is employed in place of the shutter 38 in this embodiment, the space into which the shutter is retracted to expose the connective opening has to be provided on the rear side of the collected toner box 30 in terms of the direction in which the collected toner box 30 is inserted into the image forming apparatus 10. In reality, however, there is no space available into which the shutter can be retracted, on the rear side of the collected toner box 30, in terms of the direction in which the transferring sections 50*a*, 50*b*, 50*c* and 50*d* are inserted into the collected toner box 30.

Thus, the transferring sections 50*a*, 50*b*, 50*c* and 50*d* are provided with rotational shutters 52, one for one, the rotational axis of which coincides with the axial line of the transferring sections 50*a*, 50*b*, 50*c* and 50*d*, and which keep sealed the transferring openings of the transferring sections 50*a*, 50*b*, 50*c* and 50*d*.

(Structure of Transferring Section)

Figure 4:
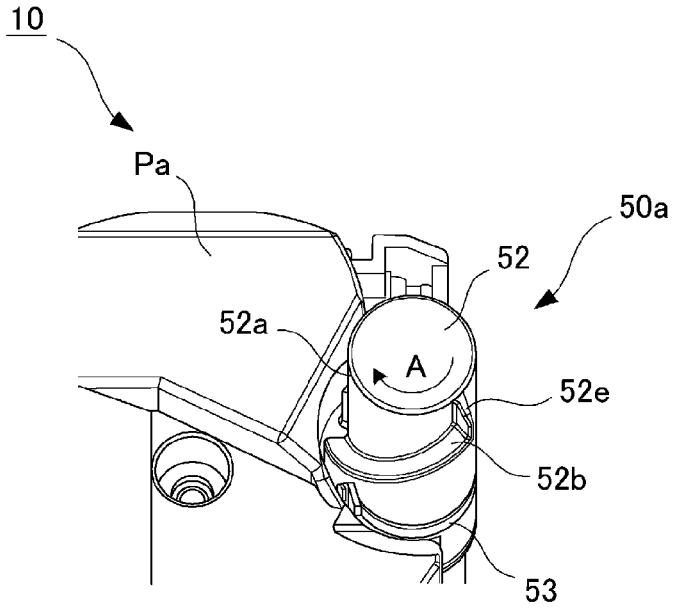
FIG. 4 is a drawing for describing the shutter mechanism in the first embodiment of the present invention.
Figure 4:
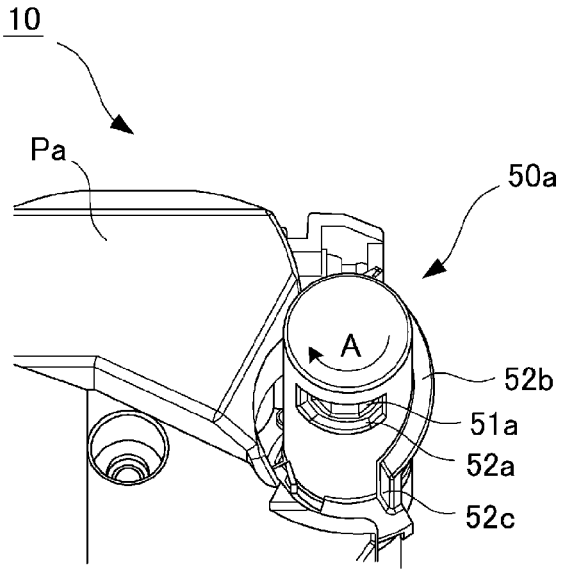
Figure 4:
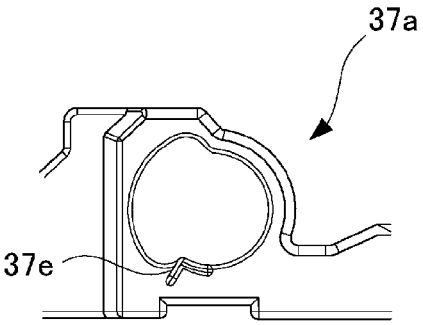
Figure 5:
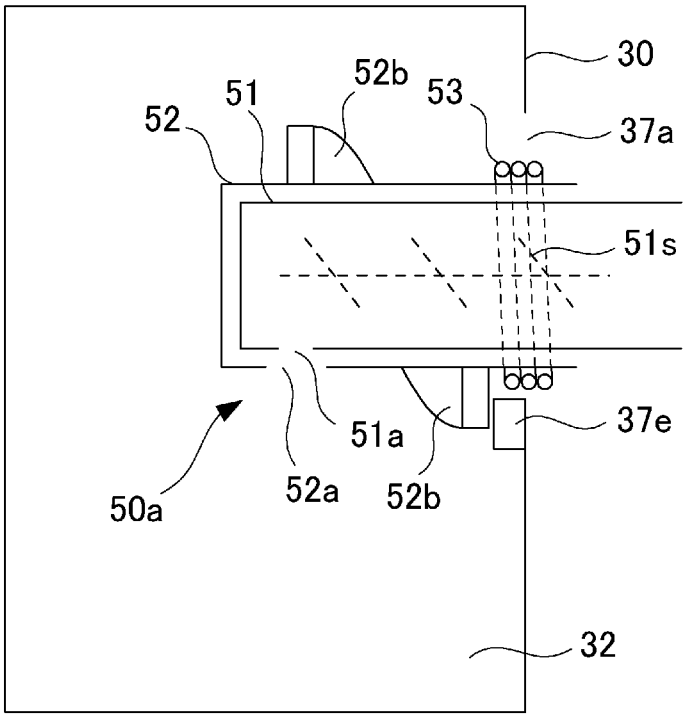
FIG. 5 is a schematic drawing for describing the operation of the shutter mechanism.

FIG. 4 is a drawing for describing the shutter mechanism in the first embodiment. FIG. 5 is a schematic drawing for describing the operation of the shutter mechanism. FIG. 4(*a*) relates to when the shutter 52 is closed. FIG. 4(*b*) relates to when the shutter 52 is open. FIG. 4(*c*) is a drawing of the shutter driving section with which the collected toner box 30 is provided.

Referring to FIG. 3(*b*), the transferring section 50*a*, which is protrusive from the image forming section Pa, is inserted into the collected toner box 30, as shown in FIG. 3(*a*), so that the used toner can be discharged into the collected toner box 30.

Referring to FIG. 4(*a*), the sealing shutter 52 is cylindrical. One end of the sealing shutter 52 is sealed, whereas the other end is open. It is fitted around the tip portion of the conveyance pipe 51 in such a manner that it can be rotationally moved about its axis, which coincides with the axis of the conveyance pipe 51. Since the sealing shutter 52 in this embodiment fits around the conveyance pipe 51, and is rotatable around the conveyance pipe 51, the space required for the sealing shutter 52 to keep the transferring opening 51*a* sealed or open, or to rotate to seal or open the transferring opening is nothing but the space which it occupies around the conveyance pipe 51. Thus, the space which the sealing shutter 52 requires to seal the transferring opening 51*a* as shown in FIG. 4(*b*) is substantially smaller than the space required by the shutter which has to be slid in the direction parallel to the collected toner box insertion direction, in order to seal the transferring opening 51*a*.

During the initial stage in the process of pushing the collected toner box 30 into the image forming apparatus 10 to attach the box 30 to the apparatus 10, the sealing shutter 52 keeps the transferring section 50*a* sealed, preventing thereby the toner from falling from the transferring section 50*a*.

Referring to FIG. 4(*b*), during the final stage of the process of attaching the collected toner box 30 to the image forming apparatus 10, the sealing shutter 52 of the transferring section 50*a* is in the position in which it keeps the transferring section 50*a* (transferring opening 51*a*) open, allowing therefore the toner to fall from the transferring section 50*a* into the collected toner box 30.

Referring to FIG. 4(*c*), the entrance 37*a* of the collected toner box 30 is provided with a contact rib 37*e*, which is for moving the shutter mechanism with which the transferring section 50*a* is provided.

In the first embodiment, the sealing shutter 52 is provided with a spiral rib 52*b* and a straight rib 52*c*. The angles θ1 (taper 1) and θ2 (taper 2) of the spiral rib 52*b* and straight rib 52*c*, respectively, are set as defined by the following inequality, in order to make the two ribs 52*b* and 52*c* different in the amount by which they convert the force provided by the torsion coil spring 53, into such force that works in the direction to rotate the sealing shutter 52. As will be described later, the angle θ is the angle of the spiral rib 52*b* and straight rib 52*c* relative to the direction in which the collected toner box 30 is inserted into, or extracted from, the image forming apparatus 10 (close contact area 90 degrees minus lead angle α of spiral).

$$\theta 1 > \theta 2$$

While the collected toner box 30 is pushed into the image forming apparatus 10, the spiral rib 52*b* remains in contact with the collected toner box 30, and rotates the sealing shutter 52. After the mounting of the collected toner box 30 into the image forming apparatus 10, the straight rib 52*c* remains in contact with the collected toner box 30.

Referring to FIG. 5, the transferring section 50*a* of the image forming section Pa is connected to the entrance 37*a* of the collected toner box 30. The used toner collected by the drum cleaning device 15*a* is conveyed by a conveyance screw 51*s* to the transfer opening 51*a* through a conveyance pipe 51.

The sealing shutter 52 is under the pressure generated by the torsion coil spring 53 in the direction indicated by an arrow mark A. Thus, when the transferring section 50*a* is not in connection to the collected toner box 30, the sealing shutter 52 always keeps the transfer opening 51*a* sealed.

While the transferring section 50*a* is inserted into the collected toner box 30, the contact rib 37*e*, with which the entrance 37*a* is provided, remains in contact with the spiral rib 52*b*, and causes the sealing shutter 52 to rotate in the opposite direction from the direction indicated by the arrow mark A in FIG. 4(*a*).

After the mounting of the collected toner box 30 into the image forming apparatus 10, the sealing shutter 52 remains stationary in such a position in which it keeps the transfer opening 51*a* aligned with the opening 52*a* of the sealing shutter 52. Thus, as the used toner is conveyed to the transfer opening 52*a* through the conveyance pipe 51, it can be discharged into the collected toner box 30 through the transfer opening 51*a*, and the opening 52*a* of the sealing shutter 52, which is in alignment with the transfer opening 51*a*.

After the mounting of the collected toner box 30 into the image forming apparatus 10, the contact rib 37*e* is in contact with the low reaction force section 52*c* (straight rib 52*c*), which is smaller in angle (greater in lead angle α) than the spiral rib 52*b*. Therefore, the force which works in the direction to push back the sealing shutter 52 in the opposite direction from the direction in which the sealing shutter 52 is inserted into the image forming apparatus 10 is small.

(Reaction Force During Mounting or Dismounting of Collected Toner Box)

Figure 7:
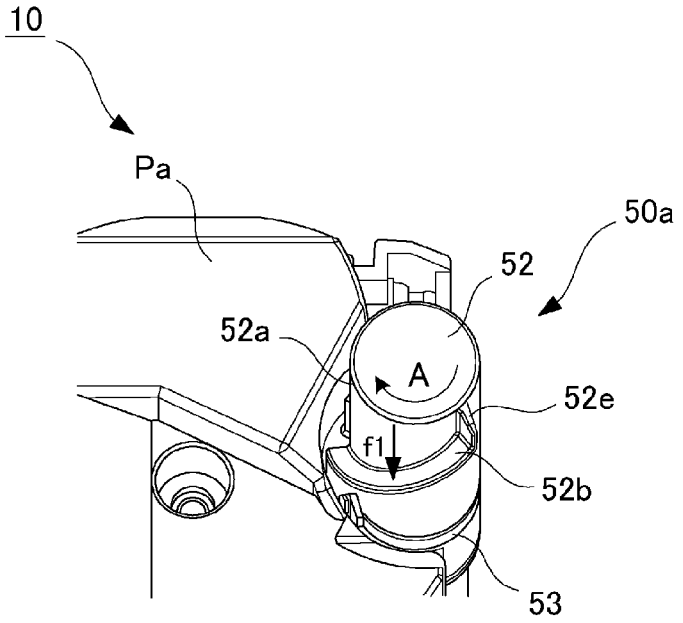
FIG. 7 is a drawing for describing the shutter mechanism in the second embodiment.
Figure 7:
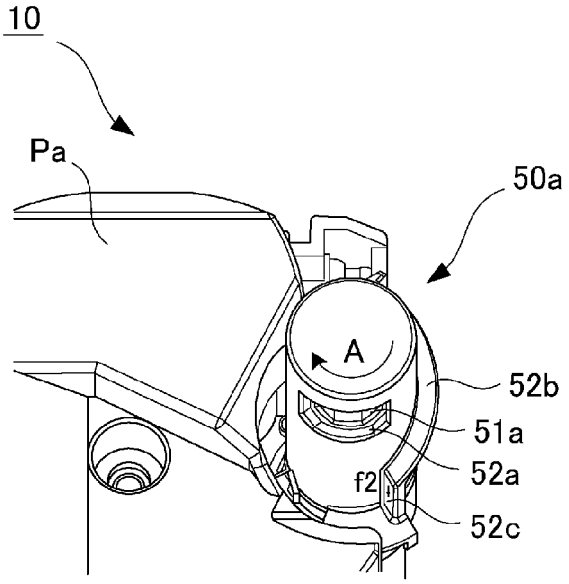
Figure 7:
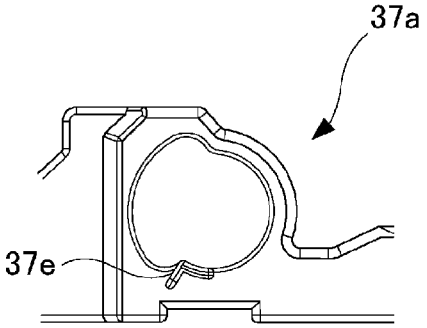

Referring to FIG. 7(*a*), while the collected toner box 30 is pushed into the image forming apparatus 10, the spiral rib 52*b* remains under the force generated by the torsion coil spring 53. A referential code f1 stands for the component of this force, which is parallel to the direction of the insertion of the collected toner box 30. Referring to FIG. 7(*b*), a referential code f2 stands for the component of the same force, which is also parallel to the direction of the insertion of the collected toner box 30. The component f1 occurs at the point of contact between the spiral rib 52*b* and contact rib 37*a*, whereas the component f2 occurs at the point of contact between the low reaction force rib 52*c* and contact rib 37*a*.

The amount of the component f1 is obtainable with the use of the following equation, in which "fc" stands for the amount of force generated by the torsion coil spring 53, and θ1 stands for the difference (90−α1) between the lead angle α1 of the spiral rib 52*b* and 90 degrees. That is, the amount of the component f1 is adjustable by the adjustment of the angle θ1 of the surface of the spiral rib 52*b* relative to the collected toner box insertion direction. Simply describing, the amount of pressure (force) applied to the surface of the spiral rib 52*b* by the torsion coil spring 53 is fc·cos θ, and the amount of the component f1 of this force equals the product between the force (pressure) applied to the surface of the spiral rib 52*b* by the torsion coil 53 and sin θ1.

$$f1=fc\cdot\sin\theta1\cdot\cos\theta1$$

The amount of the component f2 is obtainable with the use of the following equation in which fc stands for the amount of force (pressure) generated by the torsion coil spring 53; α2, the angle between the straight rib 52*c* (low reaction force section); and 02 stands for the difference between 90 degrees and the lead angle α2.

$$f2=fc\cdot\sin\theta2\cdot\cos\theta2$$

Figure 6:
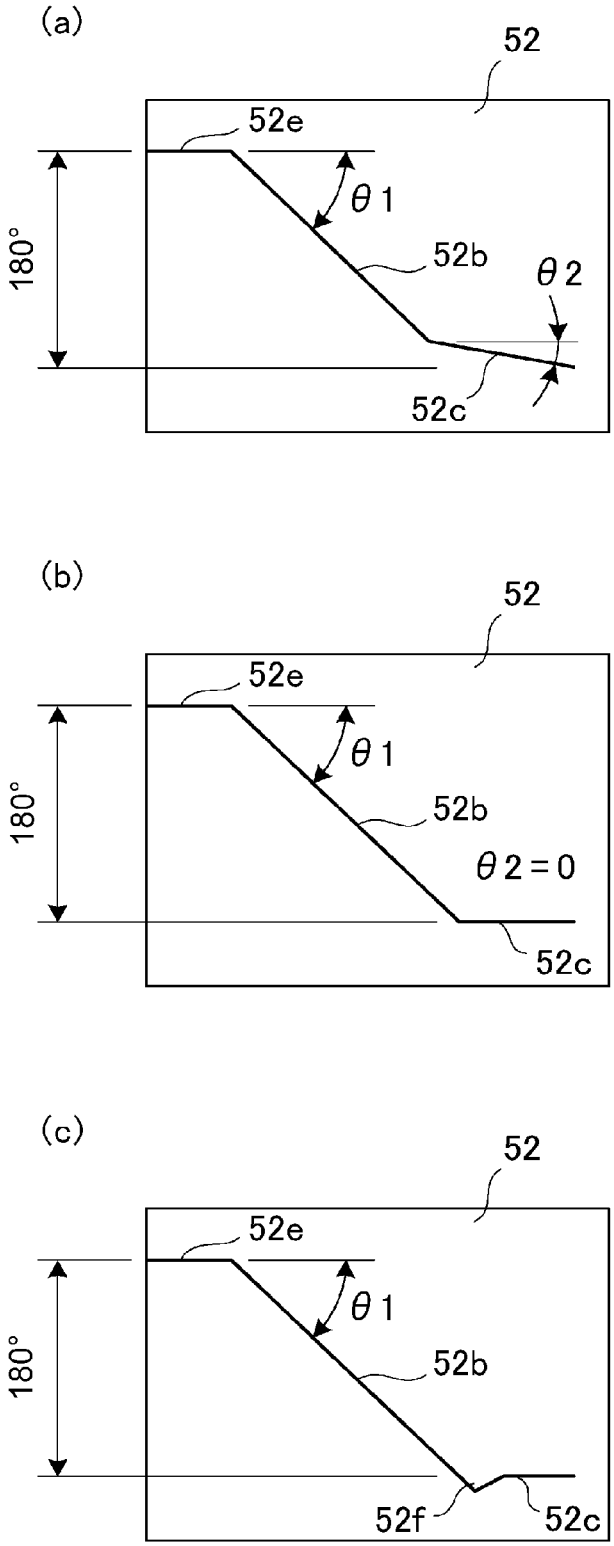
FIG. 6 is a drawing for describing the low reaction force section.

Here, if the angle θ2 (FIG. 6(*a*)) of the low reaction force area 52*c*, shown in FIG. 7(*b*), is small, the sealing shutter 52 is hardly rotated by the interaction between straight rib 52*c* and the contact rib 37*e*. Thus, even if the collected toner box 30 is not highly accurately positioned at the end of its insertion into the image forming apparatus 10, the sealing shutter 52 remains in its open position. As long as the contact rib 37*e*, shown in FIG. 7(*c*), is in contact with the low reaction force rib 52*c* of the sealing shutter 52, it is guaranteed that the sealing shutter 52 is open.

It is assumed here that after the mounting of the collected toner box 30 into the image forming apparatus 10, that is, after the connection of the four conveyance pipes 51 to the collected toner box 30, the static friction between the four conveyance pipes 51 and collected toner box 30 is F, and the reaction force which keeps the shutter 38 open is f38. By designing the image forming apparatus 10 and collected toner box 30 so that the angle θ2 of the low reaction force rib 52*c*, relative to the direction in which the collected toner box 30 is pushed into the image forming apparatus 10, satisfies the following inequality, it is possible to keep the collected toner box 30 in the preset position, with the use of only the static friction F. Thus, a belt, a lever, or the like component, for keeping the collected toner box 30 fixed to the image forming apparatus 10 is unnecessary. That is, a belt, a lever, or the like component, which has to be operated when the collected toner box 30 is inserted into, or extracted from, the image forming apparatus 10, is unnecessary. Thus, it is possible to insert or extract the collected toner box 30, into or from, the image forming apparatus 10, by simply grasping the collected toner box 30.

$$f38+4\times f2>F$$

Therefore, there is the following relationship between the static friction F and the total amount Σf2 of force applied to the collected toner box 30 by way of the low reaction force rib 52*c* by the torsion coil spring 53 in the direction to separate the collected toner box 30 from the conveyance pipe 51.

$$F>\Sigma f2$$

Further, by setting the angle θ1 of the contact surface of the spiral rib 52*b* so that the following inequality is satisfied, the component f1 can be utilized as such force that assists a user when the user pulls the collected toner box 30 out of the image forming apparatus 10.

$$f38+4\times f1>F$$

That is, the force generated by the torsion coil spring 53 to keep the sealing shutter 52 shut can be used to reduce the amount of force necessary to pull the collected toner box 30 out of the image forming apparatus 10 after the collected toner box 30 becomes heavy by being filled with the used toner. Therefore, it is unnecessary to use a large amount of force to pull the collected toner box 30 out of the image forming apparatus 10 during the initial stage of the process of pulling the collected toner box 30 out of the image forming apparatus 10. Therefore, it is less likely for the collected toner box 30 to be made to jettison out of the image forming apparatus 10 and fall, by the force applied to the collected toner box 30 to pull the collected toner box 30 out of the image forming apparatus 10.

As described above, in the first embodiment, the toner collected in the image forming section Pa is conveyed through the conveyance pipe 51 which is an example of conveying component. The collected toner box 30 which is an example of collection container is connectable to the multiple conveyance pipes 51 all at once. The collected toner box 30 can be connected to, or separated from, the conveyance pipes 51. They cumulatively store the collected toner as the collected toner flows (falls) into the collected toner box 30 through the transfer opening 51*a*.

The sealing shutter 52 which is an example of shutter is attached to the conveyance pipe 51. It is capable of opening or closing the transfer opening 51*a*, by being rotated in the direction which is perpendicular to the direction in which the collected toner box 30 is moved to be connected to the conveyance pipe 51. The sealing shutter 52 is provided with a through hole which can be aligned with the transfer opening 51*a*. It is fitted around the conveyance pipe 51, and is rotatable around the conveyance pipe 51. The spiral rib 52*b* is attached to the peripheral surface of the sealing shutter 52 in a manner to be spirally wound around the sealing shutter 52 so that its axial line coincides with the axial line of the sealing shutter 52. The sealing shutter 52 exposes the transfer opening 51*a* by being rotated so that its through hole faces downward. It covers the transfer opening 51*a* by being rotated so that its through hole faces upward.

The torsion coil spring 53, which is an example of pressure applying component, keeps the sealing shutter 52 pressured in the direction to shut. The spiral rib 52*b* which is an example of component to be contacted by the contact rib 37*e* is a part of the sealing shutter 52. As the collected toner box 30 is inserted into the image forming apparatus 10, the collected toner box 30 comes into contact with the spiral rib 52*b*. Then, as the collected toner box 30 is inserted further, the spiral rib 52*b* receives such force that works in the direction to move (rotate) the sealing shutter 52 in the opening direction.

The force which the collected toner box 30 receives from the spiral rib 52*b*, and which works in the direction to push the collected toner box 30 outward of the image forming apparatus 10 when the sealing shutter 52 is in the second position in terms of the rotational direction of the collected toner box 30 is smaller than when the sealing shutter 52 is in the first position.

(Comparison to Comparative Image Forming Apparatus)

Assume here that each of the transferring sections 50*a*, 50*b*, 50*c* and 50*d* shown in FIG. 1(*b*) is provided with a sealing shutter 52, which does not have the low reaction force straight rib 52*c* shown in FIG. 7(*b*); they have only the spiral rib 52*b*. In this case, after the mounting of the collected toner box 30 into the image forming apparatus 10, the amount of force which the sealing shutter 52 applies to the collected toner box 30 in the direction to push the collected toner box 30 out of the image forming apparatus 10 is substantial.

Next, assuming that each of the transferring sections 50*a*, 50*b*, 50*c* and 50*d* is provided with a shutter which is similar to the shutter 38 which slides in the direction in which the collected toner box 30 is inserted into, or extracted out of, the image forming apparatus 10. Also in this case, the amount of force which the sealing shutter 52 applies to the collected toner box 30 in the direction to push the collected toner box 30 out of the image forming apparatus 10 is substantial.

In these cases, it is necessary that the image forming apparatus 10 is provided with a mechanism for keeping the collected toner box 30 fixed to the image forming apparatus 10 in order to prevent the collected toner box 30 from being pushed out of the image forming apparatus 10, and falling down from the image forming apparatus 10. As an example of such a mechanism, it is possible to provide the image forming apparatus 10 with a collected toner box retention lever, which is slidable in the left-right direction, as disclosed in Japanese Laid-open Patent Application No. 2005-777513.

After the proper mounting of the collected toner box 30 into the image forming apparatus 10, the lever will have slid toward the collected toner box 30, and will be in engagement with the collected toner box 30, preventing thereby the collected toner box 30 from being pushed out of the image forming apparatus 10. That is, the pressure (force) generated by the spring with which the shutter is provided is caught by the lever. Thus, the collected toner box 30 remains properly positioned in the image forming apparatus 10. That is, the pressure (force) generated by the spring in the direction to push the collected toner box 30 out of the image forming apparatus 10 is cancelled by the collected toner box retention lever.

In the cases of the above-described comparative image forming apparatuses, if it is necessary to extract the collected toner box 30 out of the image forming apparatus 10, the retention lever has to be disengaged. As the retention lever is disengaged, the collected toner box 30 is pushed frontward of the image forming apparatus 10 by the pressure generated by the spring. Thus, even if the collected toner box 30 happens to be of the large capacity, it can be easily taken out of the image forming apparatus 10. As the collected toner box 30 is filled up with the used toner, it becomes substantial in weight, although it depends on the capacity of the collected toner box 30. However, the pressure generated by the spring works in the direction to assist an operator (user) to take the collected toner box 30 out of the image forming apparatus 10. Therefore, the collected toner box 30 can be easily taken out of the image forming apparatus 10.

However, when it is necessary to attach the collected toner box 30 to the image forming apparatus 10, the collected toner box 30 has to be properly aligned with the image forming apparatus 10, and then, has to be pushed into the image forming apparatus 10 against the force generated by the spring provided to keep the shutter pressured in the direction to remain shut. That is, it is necessary for an operator (user) to align the entrances 37*a*, 37*b*, 37*c* and 37*d* with the transferring sections 50*a*, 50*b*, 50*c* and 50*d*, respectively, while preventing the collected toner box 30 from slipping out of the image forming apparatus 10. This operation is rather difficult.

Further, if the retention lever is disengaged while the collected toner box 30 is held to the image forming apparatus 10 by the retention lever, it sometimes occurs that the collected toner box 30 is suddenly pushed out of the image forming apparatus 10 by the force generated by the spring with which the sealing shutter 52 is provided. Moreover, in a case where the collected toner box 30 is small in capacity, or the collected toner box 30 is taken out of the image forming apparatus 10 before it becomes full, it is possible that as soon as the retention lever is disengaged, the collected toner box 30 will be shot out of the image forming apparatus 10, and fall.

One of the possible solutions to this issue is to provide the image forming apparatus 10 with a regulating component other than the retention lever. However, not only does this solution make the image forming apparatus 10 complicated in structure, but also makes complicated the procedure for replacing the collected toner box 30. That is, this solution requires not only to free the collected toner box 30 by operating the retention lever, but also an additional operation of disengaging the collected toner box 30 from the regulating component. In other words, it increases the number of steps which have to be taken to replace the collected toner box 30.

In comparison, in this embodiment, when the collected toner box 30 is retained in the image forming apparatus 10, the component f2 is weaker than the maximum amount of static friction F between the collected toner box 30 and image forming apparatus 10. Therefore, a component such as the retention lever for keeping the collected toner box 30 held to the image forming apparatus 10 is unnecessary. That is, a component such as the retention lever for keeping the collected toner box 30 fixed to a preset position in the image forming apparatus 10 is unnecessary. In other words, in the first embodiment, it is unnecessary to operate a component for retaining the collected toner box 30. Therefore, an operator can install or uninstall the collected toner box 30 by directly holding the collected toner box 30 with both hands. Further, there is little possibility that when the collected toner box 30 is taken out of the image forming apparatus 10, the collected toner box 30 will be made to jettison out of the main assembly of the image forming apparatus 10 by the component f1 of the force generated by the shutter spring. That is, the image forming apparatus 10 in the first embodiment is superior to the comparative image forming apparatuses in terms of the operation for installing the collected toner box 30 into the image forming apparatus 10, and the operation for uninstalling the collected toner box 30 from the image forming apparatus 10, in particular, the operation for uninstalling the collected toner box 30.

While the collected toner box 30 is pushed into the image forming apparatus 10, the spiral rib 52*b* causes the sealing shutter 52 to rotate by remaining in contact with the contact rib 37*e* with which the entrance 37*a* is provided, whereas after the mounting of the collected toner box 30 into the image forming apparatus 10, the straight rib 52*c* (taper 2) remains in contact with the contact rib 37*e*.

Effects of Embodiment 1

In the first embodiment, the spiral rib 52*b* (first area of contact) moves (rotates) the sealing shutter 52 in the direction to expose the transfer opening 51*a* against the force generated by the torsion coil spring 53, by remaining in contact with the contact rib 37*e* (component to be contacted). The low reaction force rib 52*c* (second area of contact), which is continuous from the spiral rib 52*b*, comes into contact with the contact rib 37*e* toward the end of the process of connecting the collected toner box 30 with the conveyance pipe 51. The angle of the low reaction force rib 52*c* relative to the direction in which the collected toner box 30 is connected with the conveyance pipe 51 is zero, being smaller than the angle of the spiral rib 52*b* relative to the direction in which the collected toner box 30 is connected to the conveyance pipe 51. Therefore, the force which works in the direction to push the collected toner box 30 out of the image forming apparatus 10 when the collected toner box 30 is in its toner collection position is small.

In the first embodiment, when the collected toner box 30 is connected to the conveyance pipe 51, the entrance rib 52*e* (third area of contact), with which the sealing shutter 52 is provided, comes into contact with the contact rib 37*e* (component to be contacted) before the spiral rib 52*b* does. The angle of the entrance rib 52*e* relative to the direction of connection is zero, being therefore smaller than the angle of the spiral rib 52*b* relative to the direction of the connection. Therefore, the force which pushes the collected toner box 30 outward when the collected toner box 30 is fixed in position relative to the image forming apparatus 10 is small.

In the first embodiment, when the collected toner box 30 is in connection to the multiple conveyance pipes 51, there is the following relationship between the maximum amount of static friction F and the total amount of force f2 which torsion coil spring 53 pushes the collected toner box 30 by way of the low reaction force rib 52*c*, in the direction to separate the collected toner box 30 from the conveyance pipes 51: F>f2. Therefore, the collected toner box 30 is kept in its designated position in the image forming apparatus 10, by its own weight.

In the first embodiment, the sealing shutter 52, which is rotational, was employed. Therefore, it was possible to provide such a shutter mechanism that can open or close the sealing shutter 52 even if the distance the collected toner box 30 is moved to be installed into, or uninstalled from, the image forming apparatus 10, is short, and also, that the force generated by the spring for keeping the sealing shutter 53 shut does not act in the direction to push the collected toner box 30 out of the image forming apparatus 10. Further, it was possible to provide the sealing shutter 52, which can be adjusted in the timing with which it opens or closes, by the modification of the spiral rib 52*b* in shape (taper), and the adjustment of the spiral rib 52*b* in position.

In the first embodiment, even if the sealing shutter 52 is directly subjected to unexpected force during the shipment, or replacement, of a process cartridge, or the like situation, the sealing shutter 52 is prevented from rotating, and therefore, it is unlikely for toner to scatter from the collected toner box 30.

The first embodiment can reduce the possibility that the collected toner box 30 will slip out of the image forming apparatus 10 and fall during the replacement of the collected toner box 30.

Embodiment 2

FIG. 6 is a drawing for describing the low reaction force section of the rib of the sealing shutter 52. FIG. 7 is a drawing for describing the shutter mechanism in the second embodiment of the present invention. FIGS. 6(*a*), 6(*b*) and 6(*c*) relate to the first, second, and third embodiments, respectively. FIGS. 7(*a*) and 7(*b*) relate to when the shutter is shut, and when the shutter is open, respectively. FIG. 7(*c*) is a drawing of the shutter driving section with which the collected toner box 30 is provided.

Referring to FIG. 6(*a*), which is an extended elevation of the sealing shutter 52, the spiral guide of the sealing shutter 52 is described. In the first embodiment, the lead angle $\alpha 2$ of the low reaction force rib 52*c* is 80 degrees ($\alpha 2$=80).

Referring to FIG. 6(*b*), in the second embodiment, the lead angle $\alpha 2$ of the low reaction force rib 52*c* is 90 degrees ($\alpha 2$=90). The image forming apparatus 10 in the second embodiment is the same in structure as the image forming apparatus 10 in the first embodiment, except that in the second embodiment, the angle $\alpha 2$ of the low reaction force rib 52*c* is zero. Therefore, the components of the image forming apparatus 10, shown in FIG. 6, and the sections thereof, in the second embodiment, which are the same in structure as the counterparts in the first embodiment, are given the same referential codes as the counterparts, and are not described here.

Referring to FIG. 7(*b*), in the second embodiment, the angle $\theta 2$ of the low reaction force rib 52*c* relative to the direction in which the collected toner box 30 is pushed into the image forming apparatus 10 is zero: $\theta 2=90-\alpha 2=0$. That is, in order to make the angle $\theta 2$ zero in value, the sealing shutter 52 is structured so that the low reaction force rib 52*c* becomes parallel to the direction in which the collected toner box 30 is pushed into the image forming apparatus 10. Thus, after the mounting of the collected toner box 30 into the image forming apparatus 10, the entirety of the force generated by the torsion coil spring 53 works in the direction to rotate the sealing shutter 52 in the direction which is vertical to the direction in which the collected toner box 30 is pushed into the image forming apparatus 10. Also after the mounting of the collected toner box 30 into the image forming apparatus 10, the component f2 of the force generated by the torsion coil spring 53, which is parallel to the direction in which the collected toner box 30 is pushed into the image forming apparatus 10, is obtainable with the use of the following equation.

$$f2=fc\cdot\sin\theta2\cdot\cos\theta2=fc\cdot0\cdot1=0$$

The force generated by the torsion coil spring 53 of the sealing shutter 52 is caught in the direction perpendicular to the direction in which the collected toner box 30 is pushed into the image forming apparatus 10. Therefore, the value of the component f2 is zero: f2=0. Therefore, a component for keeping the collected toner box 30 fixed to the image forming apparatus 10 after the mounting of the collected toner box 30 into the image forming apparatus 10 is unnecessary, regardless of the maximum amount of static friction F.

More accurately, ignoring the effects of the shutter 38, it is possible to keep the collected toner box 30 fixed to the image forming apparatus 10, with no relation to the maximum amount of static friction F, after the mounting of the collected toner box 30 into the image forming apparatus 10. That is, the collected toner box 30 can be properly positioned relative to the image forming apparatus 10 without being affected by the friction F between the collected toner box 30 and image forming apparatus 10.

During an operation for replacing the collected toner box 30 in the image forming apparatus 10, it is unnecessary to operate the fixing component. Therefore, it is possible for an operator (user) to pull the collected toner box 30 out of the image forming apparatus 10, or push the collected toner box 30 into the image forming apparatus 10, by holding the collected toner box 30 with both hands. Further, there is little possibility that during the extraction or insertion of the collected toner box 30, the collected toner box 30 will be made to jettison out of the image forming apparatus 10 by the component f1 of the force generated by the torsion coil spring 53 of the sealing shutter 52.

Embodiment 3

The collected toner box 30 in the third embodiment is the same in structure as that in the first embodiment, except that the low reaction force rib 52*c* of the sealing shutter 52 is provided with a protrusion for generating clicking sound as the collected toner box 30 settles into its designated position in the image forming apparatus 10. Therefore, the components of the image forming apparatus 10 and collected toner box 30, the sections thereof, etc., shown in FIG. 6(*c*), which are the same in structure as the counterparts, shown in FIG. 6(*a*), in the first embodiment are given the same referential codes as the counterparts, and are not described in order not to repeat the same description.

Referring to FIG. 6(*c*), in the third embodiment, the low reaction force rib 52*c* is provided with a protrusion 52*f*, so that a clicking sound is generated as the collected toner box 30 settles into its designated position in the image forming apparatus 10, at the end of the process of pushing the collected toner box 30 into the image forming apparatus 10.

Embodiment 4

Figure 8:
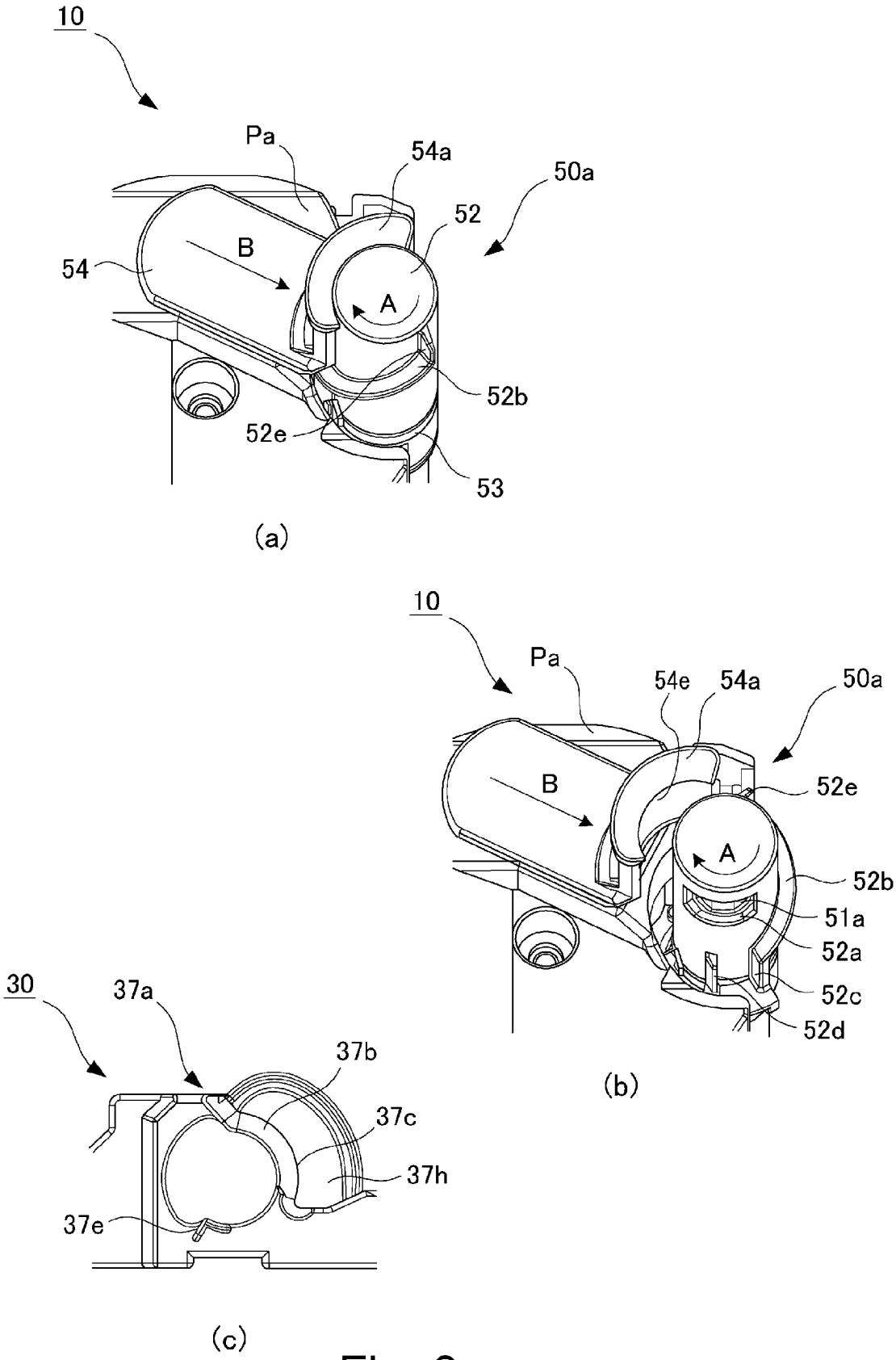
FIG. 8 is a drawing for describing the blind shutter mechanism in the third embodiment
Figure 9:
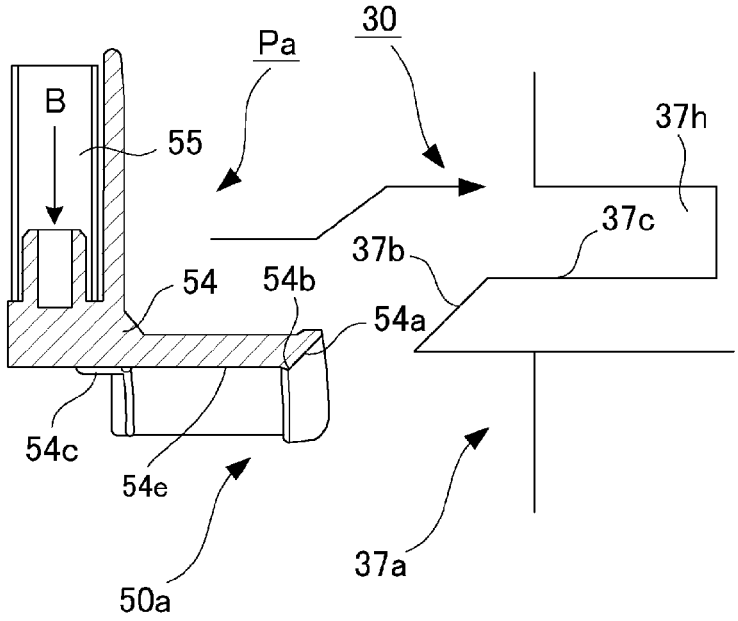
FIG. 9 is a drawing for describing the operation of the blind shutter.

FIG. 8 is a drawing for describing the blind shutter mechanism in the fourth embodiment of the present invention. FIG. 9 is a drawing for describing the operation of the blind shutter mechanism. FIGS. 8(*a*) and 8(*b*) relate to when the blind shutter is closed, and open, respectively. FIG. 8(*c*) is a drawing of the shutter driving section with which the collected toner box 30 is provided.

The collected toner box 30 in the fourth embodiment is the same in structure as that in the second embodiment, except that the collected toner box 30 in the fourth embodiment is provided with a blind shutter. Therefore, the structural components of the collected toner box 30, and portions thereof, shown in FIG. 8, which are the same in structure as the counterparts in the second embodiment are given the same referential codes as those given to the counterparts, and are not described here in order not to repeat the same description.

Referring to FIG. 8(*b*), with the collected toner box 30 (FIG. 3) being installed in the image forming apparatus 10, the transferring section 50*a* discharges the used toner into the collected toner box 30 from the drum cleaning device 15*a*. While the used toner is moved through the transfer opening 51*a*, it adheres to the edges of the opening 52*a* of the sealing shutter 52.

Referring to FIG. 8(*a*), as the collected toner box 30 (FIG. 3) is removed from the image forming apparatus 10, the sealing shutter 52 seals the transfer opening 51*a*. Then, the blind shutter 54 comes into contact with the sealing shutter 52 in a manner to cover the opening 52*a* of the sealing shutter 52, reducing thereby the possibility of contamination attributable to the scattering of toner from the opening 52*a* of the sealing shutter 52.

Referring to FIG. 8(*b*), the blind shutter 54 is movable relative to the image forming section Pa in the direction indicated by an arrow mark B, which is perpendicular to the axial line of the conveyance pipe 51.

Referring to FIG. 8(*c*), the collected toner box 30 is provided with a tapered surface 37*b*, which is next to the entrance 37*a*. It is also provided with a recess 37*h*, into which the sealing section 54*e* of the blind shutter 54, shown in FIG. 8(*b*), is retractable. The recess 37*h* is next to the tapered surface 37*b*. Referring to FIG. 9, as the sealing section 54*e* of the blind shutter 54 is retracted into the recess 37*h*, it comes into contact with the surface 37*c* which is next to the tapered surface 37*b*.

Referring to FIG. 9, the blind shutter 54 remains under the pressure generated by a compression spring 55 in the direction to keep the blind shutter 54 in contact with the sealing shutter 52. When the collected toner box 30 is not in connection to the transferring sections 50, the blind shutter 54 always keeps the opening 52*a* of the sealing shutter 52 shut.

In terms of the direction in which the blind shutter 54 is moved to be shut, the tapered surface 54*a* is a part of the downstream (front) edge portion of the blind shutter 54. Thus, as the collected toner box 30 is moved close to the transferring section 50*a*, the tapered surface 37*b* of the entrance 37*a* comes into contact with the tapered surface 54*a* of the blind shutter 54, and pushes up the blind shutter 54 in the opposite direction from the direction indicated by the arrow mark B. The timing with which the blind shutter 54 is to be opened or closed can be adjusted by adjusting the blind shutter 54 in the position of its tapered surface 54*a* in terms of the direction in which the collected toner box 30 is pushed into the image forming apparatus 10.

While the blind shutter 54 is pushed up by the tapered surface 37*b*, a component f3 of the force generated by the compression spring 55, the axial line of which is parallel to the direction in which the collected toner box 30, is pushed into the image forming apparatus 10, is affected in amount by the angle θ3 between the tapered surface 54*a* of the blind shutter 54 and the tapered surface 37*b* of the entrance 37.

After the completion of the mounting of the collected toner box 30 into the image forming apparatus 10, the contact surface 37*c* remains in contact with the contact surface 54*b*, whereas the sealing section 54*e* of the blind shutter 54 remains separated from the sealing shutter 52.

While the blind shutter 54 moves along the contact surface 37*c*, the component f4 of the force generated by the compression spring 55, which is parallel to the direction in which the collected toner box 30 is pushed into the image forming apparatus 10, is affected in amount by the angle θ4 between the contact surface 54*b* of the blind shutter 54 and the contact surface 37*c* of the entrance 37.

If the collected toner box 30 is structured so that the contact surface 37*c* becomes parallel to the direction in which the collected toner box 30 is pushed into the image forming apparatus 10, the angle θ4 between the contact surface 37*c* and contact surface 54*c* is zero (θ4=0). In such a case, the entirety of the force generated by the compression spring 55 when the collected toner box 30 is in the image forming apparatus 10 is perpendicular to the direction in which the collected toner box 30 is pushed into the image forming apparatus 10, and therefore, the component f4, which is parallel to the direction in which the collected toner box 30 is pushed into the image forming apparatus 10 is zero (f4=0). With the component f4 being zero, the blind shutter 54 does not need to be taken into consideration during a process of designing a component for keeping the blind shutter 54 fixed to the image forming apparatus 10.

As described above, the blind shutter 54 which is an example of sealing component is enabled to seal the through hole of the sealing shutter 52 by being moved in the direction perpendicular to the rotational axis of the sealing shutter 52. The compression spring 55 which is an example of another pressure applying component keeps the blind shutter 54 pressured in the direction to seal the through hole. While the collected toner box 30 is connected to the conveyance pipes 51, the tapered surfaces 54*a* and 37*b* which are examples of the first tilted surface, cause the blind shutter 54 to move in the direction to open the through hole, against the force generated by the compression spring 55. The contact surfaces 54*b* and 37*c* which are examples of the second tilted surface support the blind shutter 54 against the force generated by the compression spring 55 after the first tilted surfaces. The angle of the contact surfaces 54*b* and 37*c* relative to the direction in which the collected toner box 30 is connected is smaller than the angle of the tapered surfaces 54*a* and 37*b* relative to the abovementioned direction in which the collected toner box 30 is connected.

(Reaction Force During Mounting or Dismounting of Collected Toner Box)

In the fourth embodiment, the component f4 of the force generated by the compression spring 55 to press the blind shutter 54, which is parallel to the direction in which the collected toner box 30 is pushed into the image forming apparatus 10, acts on the collected toner box 30. Therefore, the condition which keeps the empty collected toner box 30 fixed in position in the image forming apparatus 10 with the use of only the maximum amount of static friction can be expressed in the form of the following inequality.

$$f3+4\times f2+4\times f4<F$$

Further, the condition which makes it possible to utilize the component f3 of the force generated by the compression spring 55 for the blind shutter 54, which is parallel to the direction in which the collected toner box 30 is pushed into the image forming apparatus 10, when the collected toner box 30 is extracted from the image forming apparatus 10, can be expressed in the form of the following inequality.

$$f3+4\times f2+4\times f4<F$$

Therefore, a component for keeping the collected toner box 30 fixed in position in the image forming apparatus 10 is unnecessary. That is, there is no component to be operated to fix the collected toner box 30 to the image forming apparatus 10. Therefore, it is possible for a user (operator) to directly hold the collected toner box 30 when installing or uninstalling the collected toner box 30.

(Rotation Control Configuration)

Figure 10:
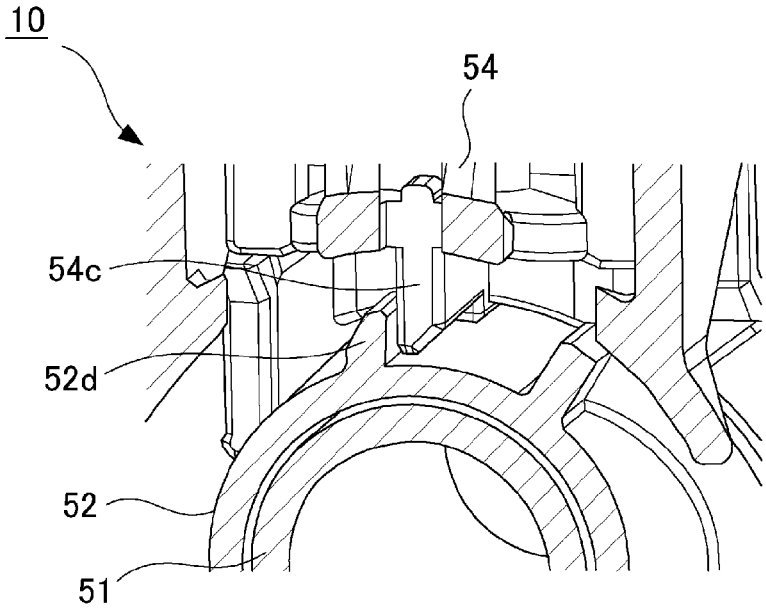
FIG. 10 is a drawing for describing the configuration of the rotation controlling section.

FIG. 10 is a drawing for describing the rotation controlling configuration of the blind shutter 54. Referring to FIG. 10, the blind shutter 54 doubles as a component for regulating the rotation of the sealing shutter 52.

It is possible that when a process unit P is replaced by a user, or in the like situation, the user will unintentionally open the sealing shutter by accidentally touching the sealing shutter 52, allowing thereby toner to scatter from the collected toner box 30. The blind shutter 54 is shaped to prevent this problem.

The surface of the blind shutter 54, which faces the sealing shutter 52, is provided with a rotation control rib 54*c*, whereas the surface of the sealing shutter 52, which faces the blind shutter 54, is provided with a rotation control rib 52*d*.

When the collected toner box 30 is out of the image forming apparatus 10, the rotational control rib 54*c* of the blind shutter 54 remains in contact with the rotation control rib 52*d* of the sealing shutter 52 to regulate the rotation of the sealing shutter 52.

During the first stage of the mounting of the collected toner box 30 into the image forming apparatus 10, the blind shutter 54 comes into contact with the tapered surface 37*b* of the entrance 37*a*, and is opened by the surface 37*b*. At the same time, the rotational control rib 54*c* becomes disengaged from the rotation control rib 52*d*, allowing thereby the sealing shutter 52 to rotate.

Thereafter, the entrance 37 comes into contact with the sealing shutter 52, and opens the sealing shutter 52, ending thereby the process of installing the collected toner box 30 into the image forming apparatus 10.

In the fourth embodiment, the blind shutter 54 is shaped to control the rotation of the sealing shutter 52. Therefore, when the collected toner box 30 is out of the image forming apparatus 10, the blind shutter 54 controls the rotation of the sealing shutter 52 to prevent the sealing shutter 52 from opening. Thus, it is unlikely for toner to leak from the collected toner box 30. Further, as the collected toner box 30 is installed into the image forming apparatus 10, the sealing shutter 52 is automatically released, that is, with no need for an operation other than the insertion of the collected toner box 30, by the blind shutter 54, being thereby allowed to rotate.

OTHER EMBODIMENTS

The present invention can be embodied in the form of an image forming apparatus other than those in the preceding embodiments, which is partially or entirely different in structure from those in the preceding embodiments, as long as the apparatus is structured so that as a collection container is inserted into the apparatus, the resistance which the collection container encounters reduces during the latter stage of closing of the shutter of the collection container. The rotation controlling section of the collection container does not need to be spiral. That is, it may be in the form of a flat surface having a guiding groove as shown in FIG. 6. The rotation controlling spiral section does not need to be in the form of a spiral blade. That is it may be in the form of a spiral groove.

In the first embodiment, the contact rib 37*e*, which is an example of a section to be contacted, is a part of the collected toner box 30 which is an example of the other component, and the spiral rib 52*b*, which is an example of the first rotation controlling section, is a part of the sealing shutter 52 which is an example of another component. The first and second components may be reversed in their role.

The present invention can be embodied in the form of any image forming apparatus regardless of its charging method, electrostatic image forming method, transferring method, and fixing method. In the above-described embodiments, the image forming apparatuses were color image forming apparatuses of the so-called tandem type. However, the present invention can be embodied in the various forms of image forming apparatus other than those in the preceding embodiment. In the case of an image forming apparatus in accordance with the present invention, the reaction force which occurs as a collection container is connected to an image forming apparatus substantially reduces toward the end of the process of opening the shutter of the container, and therefore, the force which works in the direction to push the container out of the image forming apparatus substantially reduces. Therefore, it is unlikely for the collection container to be pushed out of the image forming apparatus by the force for keeping the shutter closed.

INDUSTRIAL APPLICABILITY

According to the present invention, it is possible to provide an image forming apparatus which does not require a component for keeping a collection container fixed in the apparatus, and yet, is capable of preventing a collection container from being displaced from its designated position in the image forming apparatus by the force which presses on the shutter of the collection container, and which is greater in the amount by which the shutter of the collection container is rotated as the container is inserted into the image forming apparatus, than any conventional image forming apparatus.

The invention claimed is:

1. An image forming apparatus comprising:

an image forming portion configured to form a toner image;

a feeding portion configured to feed toner collected in said image forming portion;

a collection container connectable with and disconnectable from said feeding portion and configured to accumulate the collected toner entering through an opening of said feeding portion;

a shutter provided on said feeding portion and movable in a direction crossing with a direction of connection with said collection container, said shutter being capable of opening and closing said opening;

an urging member configured to urge said shutter in a closing direction;

a drive receiving portion provided on said shutter and configured to receive a driving force from said collection container in a process of connecting said collection container to said feeding portion; and a drive applying portion provided on said collection container and contactable to said drive receiving portion in the process of connecting said collection container to said feeding portion to apply a driving force for moving said shutter in an opening direction against a force applied by said urging member, wherein one of said drive applying portion and said drive receiving portion includes a first contact path contactable to the other portion in the process of connecting said collection container to said feeding portion, and a second contact path contactable to the other portion after said first contact path, and wherein an inclination angle of said second contact path relative to the direction of connecting said collection container to said feeding portion is less than an inclination angle of said first contact path relative to the direction of connecting said collection container to said feeding portion, wherein said first contact path includes a spiral portion provided on a periphery of said feeding portion, and said shutter is rotated by the other portion contacting said spiral portion.

2. An apparatus according to claim 1, wherein a force applied from said drive receiving portion to said collection container in a mounting direction in a mounting operation of said collection container when said shutter is in a second rotational position which is more downstream than a first rotational position in the opening direction is smaller than that when said shutter is in the first rotational position.

3. An apparatus according to claim 1, wherein an inclination angle of said second contact path relative to the connecting direction is 0 degree.

4. An apparatus according to claim 1, wherein a plurality of such feeding portions are simultaneously connectable with said collection container, and wherein a maximum static friction force F of said collection container in a state in which said collection container is connected with such feeding portions and a total force f2 of forces applied by said urging member through said second contact path in a direction of separating said collection container from said feeding portion satisfy F>f2.

5. An apparatus according to claim 1, wherein said one of portions includes a third contact path contactable to the other portion before said first contact path in the process of connecting said collection container to said feeding portion, and an inclination angle of said third contact path relative to the connecting direction is less than the inclination angle of said first contact path relative to the connecting direction.

6. An apparatus according to claim 5, wherein the inclination angle of said third contact path relative to the connecting direction is 0 degree.

7. An apparatus according to claim 1, wherein said shutter is provided with a through-hole which is capable of being overlaid on said opening and which is rotatable outside an outer peripheral surface of said feeding portion, and said first contact path is provided in a spiral form coaxial with a rotational axis of said shutter on an outer periphery thereof.

8. An apparatus according to claim 7, wherein said shutter opens said opening in a state that said through-hole is moved down, and closes said opening in a state that said through-hole is moved up.

9. An apparatus according to claim 7, further comprising a sealing member capable of sealing said through-hole by movement in a direction perpendicular to the rotational axis of said shutter, another urging member configured to urge said sealing member in a direction of sealing said through-hole, a first inclined surface provided on at least one of said sealing member and said collection container and configured to move said sealing member in a direction of opening said through-hole against an urging force of said another urging member in the process of connecting said collection container to said feeding portion, and a second inclined surface provided on said collection container configured to support said sealing member after said first inclined surface against the urging force of said another urging member, wherein an inclination angle of said second inclined surface relative to the direction of connection is less than that of said first inclined surface.

* * * * *